US006336435B1

(12) United States Patent
Yoshikawa et al.

(10) Patent No.: US 6,336,435 B1
(45) Date of Patent: Jan. 8, 2002

(54) OUTBOARD MOTOR

(75) Inventors: Yukihiro Yoshikawa; Takeshi Toyama; Kazuo Mineno, all of Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/578,452

(22) Filed: May 26, 2000

(30) Foreign Application Priority Data

May 28, 1999 (JP) ..... PH11-150258

(51) Int. Cl.[7] ..... F01M 11/03; F02N 17/00

(52) U.S. Cl. ..... 123/195 P; 123/196 A; 123/179.25; 123/195 A

(58) Field of Search ..... 123/195 P, 195 HC, 123/195 A, 196 A, 196 W, 179.25; 440/85

(56) References Cited

U.S. PATENT DOCUMENTS 5,207,195 A * 5/1993 McClintic ..... 123/179.25
5,309,877 A * 5/1994 Shigedomi et al. ..... 123/195 P
5,438,963 A * 8/1995 Tsunoda et al. ..... 123/54.4
5,460,555 A * 10/1995 Fukuoka et al. ..... 440/88
5,501,188 A * 3/1996 Fukuoka ..... 123/179.25
5,613,470 A * 3/1997 Shiomi et al. ..... 123/195 P
5,617,821 A * 4/1997 Tsunoda et al. ..... 123/195 P
5,904,604 A * 5/1999 Suzuki et al. ..... 440/84
5,984,742 A * 11/1999 Kimura et al. ..... 440/77

* cited by examiner

*Primary Examiner*—Willis R. Wolfe
*Assistant Examiner*—Hai Huynh
(74) *Attorney, Agent, or Firm*—Oblon, Spival, McClelland, Maier & Neustadt, P.C.

(57) ABSTRACT

An outboard motor includes an engine disposed above an engine holder in a mounted usable state of the outboard motor, and the engine comprises a crankcase in which a crankshaft extends vertically perpendicularly, a cylinder block disposed rear side of the crankcase, and a cylinder head disposed rear side of the cylinder block. A starter motor mounted to a front surface of the crank case and an oil filter is further mounted to the crank case at a portion below the starter motor.

7 Claims, 8 Drawing Sheets

OUTBOARD MOTOR

CROSS-REFERENCE TO RELATED APPLICATIONS

This application is related to and claims priority, under 35 U.S.C. §119, from Japanese Patent Application No. 11-150258, filed on May 28, 1999, the entire contents of which are hereby incorporated by reference herein.

BACKGROUND OF THE INVENTION

1. Field of the Invention

The present invention relates to an outboard motor having an engine to which a starter motor and an oil filter are mounted.

2. Discussion of Background

In general, an engine of an outboard motor is mounted such that a crankshaft is directed vertically uprightly, and the engine comprises a crankcase directed forward (towards a hull in a mounted state of the outboard motor), a cylinder block disposed to a rear portion of the crankcase and a cylinder head disposed to a rear portion of the cylinder block. When the engine is of a four-stroke-cycle in-line multi-cylinder type, an intake system is disposed on one side of the engine, and an exhaust system, an electrical equipment box, an oil filter and the like are disposed on the other side of the engine as shown in Japanese Patent Laid-open Publication No. HEI 10-176541. A starter motor for starting the engine is disposed in a central portion of a front surface of the crankcase. By disposing each of these parts in accordance with such a layout, a space in a small engine cover of the outboard motor can be utilized effectively, and the balance of weight between the left and right sides of the outboard motor can be achieved.

Further, for fixing the starter motor, there is a fixing structure as shown in FIGS. 9 and 10 in which fixing pieces 102 and 103 projecting from a peripheral surface of a starter motor 101 are fastened to starter fixing bosses 105 and 106 integrally extending from a crankcase 104 from the front side by fixing bolts 107, and an exclusive mounting bracket is omitted to reduce the number of parts. In this arrangement, the axial direction of each fixing bolt 107 is horizontal direction.

However, according to the above structure, since the oil filter is disposed on a side surface of the engine, when the outboard motor is mounted to a hull and it is difficult to touch the oil filter with a hand and also difficult to exchange the oil filter, and maintenance performance of the engine is poor. On the other hand, electric equipments and the like are disposed below the starter motor in many cases, but since this position is located below the engine, it is not preferable in terms of waterproofing. Further, since the starter motor largely projects to the central portion of the front surface of the crankcase, forward and backward length of the engine is increased.

On the other hand, if the starter motor 101 is fixed to the crankcase 104 as shown in FIGS. 9 and 10, since the axial direction of the fixing bolt 107 does not coincide with the axial direction of a crank bearing 108 formed on the crankcase 104, the crank bearing 108 and a screw hole of the fixing bolt 107 must be formed separately. As a result, the relative positional precision of the starter motor 101 with respect to the crankshaft will be ensured, and there is an adverse possibility that engagement backlash between a pinion gear of the starter motor 101 and a ring gear of a flywheel which is mounted at an upper end of the crankshaft after the engine is assembled becomes improper.

The crankcase 104 is formed at its outer surface with a large number of parts such as fastening bosses for fastening and fixing the crankcase 104 itself to the cylinder block and also formed with part fixing bosses for disposing other parts. Therefore, it is difficult to freely set and design upper and lower positions of the starter fixing bosses 105 and 106. Further, in the case of the fixing structure shown in FIG. 9, if the heights of the left and right starter fixing bosses 105 and 106 are slightly inaccurate, torsion or bending stress is applied to the fixing pieces 102, 103 of the starter motor 101, and service life of the fixing pieces 102, 103 may therefore be shortened. On the other hand, in the case of the fixing structure shown in FIG. 10, since a working direction of the screw hole of the fixing bolt 107 is quite different from those of many other holes, working cost will be increased.

As described above, since there are many constraints for mounting the starter motor, in order to dispose the starter motor at a desired position, it is necessary to form the fixing pieces of the starter motor into complicated shapes. However, this results in increase in cost for producing the starter motor, and results in reduction in general utilization. In addition, when the starter motor is mounted to the crankcase, it is necessary to hold the heavy starter motor with one hand and to fasten the fixing bolt with the other hand at the same time, thus the operability of the outboard motor being made poor.

SUMMARY OF THE INVENTION

The outboard motor of the present invention has been invented to solve the above problems, and it is a first object of the invention to provide an outboard motor including an improved arrangement of a starter motor and an oil filter for effectively utilizing a space, for easily exchanging the oil filter from a hull side and for enhancing the maintenance performance of an engine.

Another object of the present invention is to provide an outboard motor capable of shortening a forward and backward length of the engine to make the outboard motor compact.

A further object of the present invention is to provide an outboard motor capable of enhancing the relative positional precision of the starter motor with respect to a crankshaft, enhancing the flexibility of mounting position of the starter motor and enhancing the mounting operation of the starter motor.

A still further object of the present invention is to provide an outboard motor having an improved outer appearance and providing an improved fixing structure for the starter motor and others.

These and other objects can be achieved according to the present invention buy providing an outboard motor comprising:

an engine disposed of a vertical type including a crankcase in which a crankshaft extends vertically perpendicularly, a cylinder block disposed rear side of the crankcase, and a cylinder head disposed rear side of the cylinder block in a usable mounted state of the outboard motor;

a starter motor mounted to a front surface portion of the crankcase; and an oil filter mounted to the crankcase at a portion below the starter motor.

In preferred embodiments, the starter motor and said oil filter are disposed so as to be deviated sideways in locations with respect to an axis of the crankshaft as viewed in a front view.

The crankcase is provided at an upper portion thereof with a starter fixing boss projecting horizontally and the starter motor is fastened to the starter fixing boss by means of fixing bolt which is directed in a perpendicular direction. The starter motor is provided with a fixing flange which spreads in a horizontal direction and the fixing flange is mounted on the starter fixing boss by means of the fixing bolt.

The crankcase is provided with a starter holding boss located below the starter fixing boss, a holding band is fixed to the starter holding boss, and a lower portion of the starter motor is held between the holding band and the starter holding boss. An electrical element such as relay is disposed between said starter fixing boss and said starter holding boss, and at least one of the starter fixing boss and said starter holding boss is integrally formed with a fixing boss for fixing the electrical element.

According to the outboard motor of the structures mentioned above, it is possible to dispose a starter motor and an oil filter while efficiently utilizing a space, to easily exchange the oil filter from a hull side and to shorten the forward and backward length of the engine, making the outboard motor compact.

It is possible to enhance the relative positional precision of the starter motor with respect to a crankshaft and to enhance the flexibility of the mounting position and the mounting operation of the starter motor. The starter motor can reliably be held with a simple structure.

Still furthermore, it is possible to dispose other parts around the starter motor while utilizing a space efficiently and enhancing outer appearance, to enhance the strength of part fixing bosses to enhance the resistance to vibration and to reduce the weight.

The nature and further characteristic features of the present invention will be made more clear from the following descriptions made with reference to the accompanying drawings.

DETAILED DESCRIPTION OF THE PREFERRED EMBODIMENTS

A preferred embodiment of the present invention will be explained hereunder with reference to the accompanying drawings.

Figure 1:
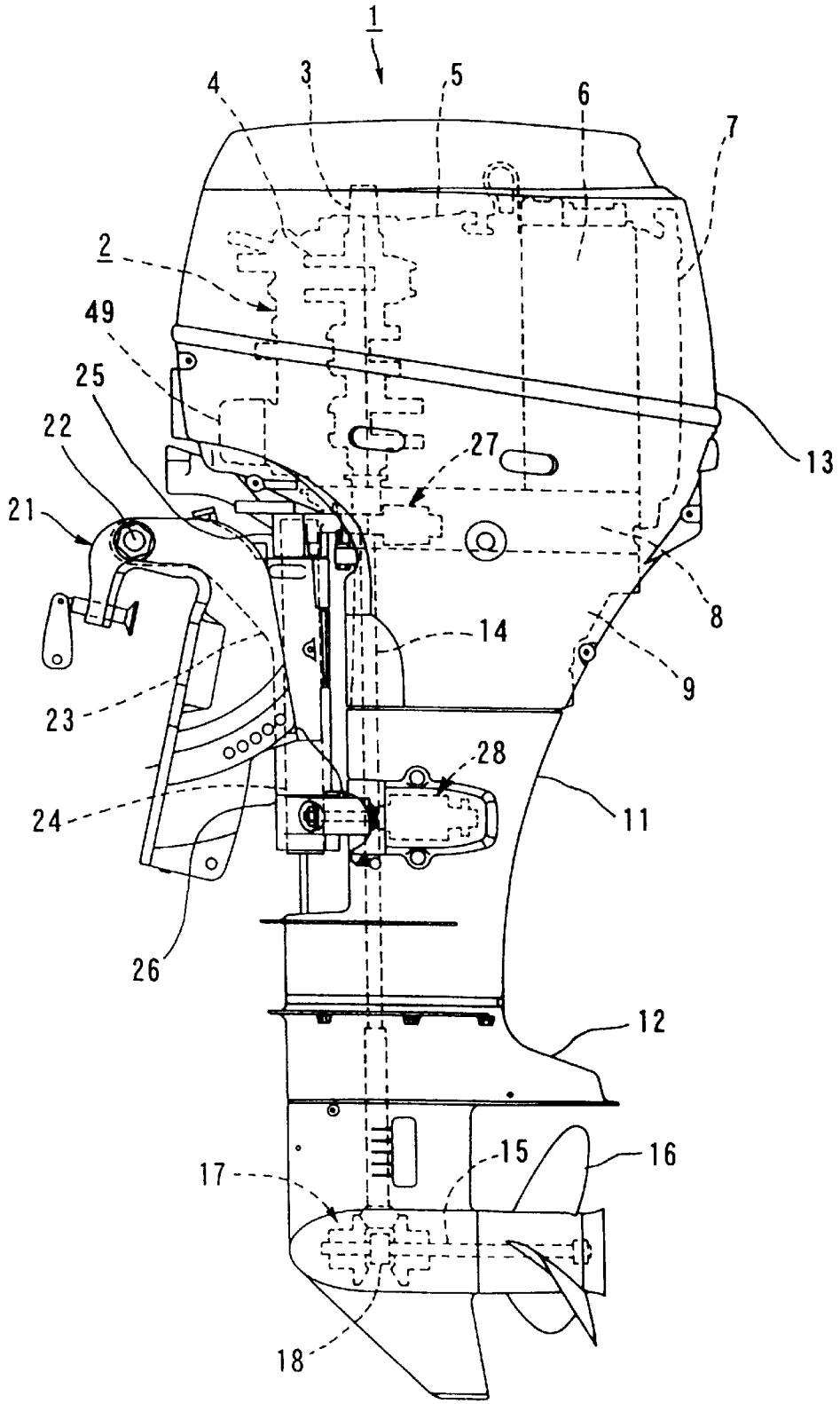
FIG. 1 is a left side view showing one example of an outboard motor according to the present invention.

With reference to FIG. 1, showing an outboard motor in a state mounted to a hull, for example, an engine 2 is mounted in an uppermost portion of an outboard motor 1. The engine is an in-line three-cylinder four-stroke-cycle gasoline engine, for example, and is mounted on a flat-plate like engine holder 8 such that a crankshaft 3 is directed vertically uprightly, and a crankcase 4, a cylinder block 5, a cylinder head 6, and a head cover 7 are disposed in this order from the front side (right in FIG. 1) of the outboard motor 1.

An oil pan 9 is fixed to a lower surface of the engine holder 8. A drive shaft housing 11 and a gear housing 12 are fixed to a lower portion of the oil pan 9 in this order. The engine 2, the engine holder 8 and the oil pan 9 are covered with an engine cover 13 for waterproofing.

A drive shaft 14 is connected to a lower end of the crankshaft 3 of the engine 2 such that the drive shaft 14 rotates in unison with the crankshaft 3. The drive shaft 14 extends downward, vertically passes through the engine holder 8, the oil pan 9 and the drive shaft housing 11 and reaches inside of the gear housing 12. A propeller shaft 15 is pivotally supported within the gear housing 12 in the horizontal (longitudinal) direction and is provided at its rear end with a screw propeller 16 such that the screw propeller 16 rotates in unison with the propeller shaft 15.

A bevel gear mechanism 17 and a clutch shifter 18 are provided at a portion at which the drive shaft 14 and the propeller shaft 15 are intersecting. The rotation of the drive shaft 14 is transmitted to the propeller shaft 15 through the bevel gear mechanism 17 so that the screw propeller 16 is rotated to generate a propulsion force. The direction of rotation of the drive shaft 14 which always rotates in a constant direction is switched from a normal direction to a reverse direction or vice versa by a clutch shifter 18, and the rotation is transmitted to the propeller shaft 15 so that forward and backward movements of the outboard motor 1 (i.e. hull) are selected.

The outboard motor has a body portion having the above-described structure which is provided, at its front portion, with a clamp bracket 21 fixed to a hull (stern plate) of a boat, ship or like. The clamp bracket 21 is provided with a swivel bracket 23 through a tilt shaft 22 and a steering shaft 24 pivotally supported vertically in the swivel bracket 23. The steering shaft 24 is provided, at its upper end and lower end, with an upper mount bracket 25 (steering bracket) and a lower mount bracket 26, respectively, to be integrally rotatable.

A pair of left and right upper mount units 27 provided in the vicinity of a front edge of the engine holder 8 are connected to the upper mount bracket 25. A pair of lower mount units 28 disposed on left and right opposite sides of the drive housing are connected to the lower mount bracket 26. With this structure, the body of the outboard motor 1 can turn (steer) leftward and rightward around the steering shaft 24 and can tilt up around the tilt shaft 22 with respect to the bracket 21.

Figure 2:
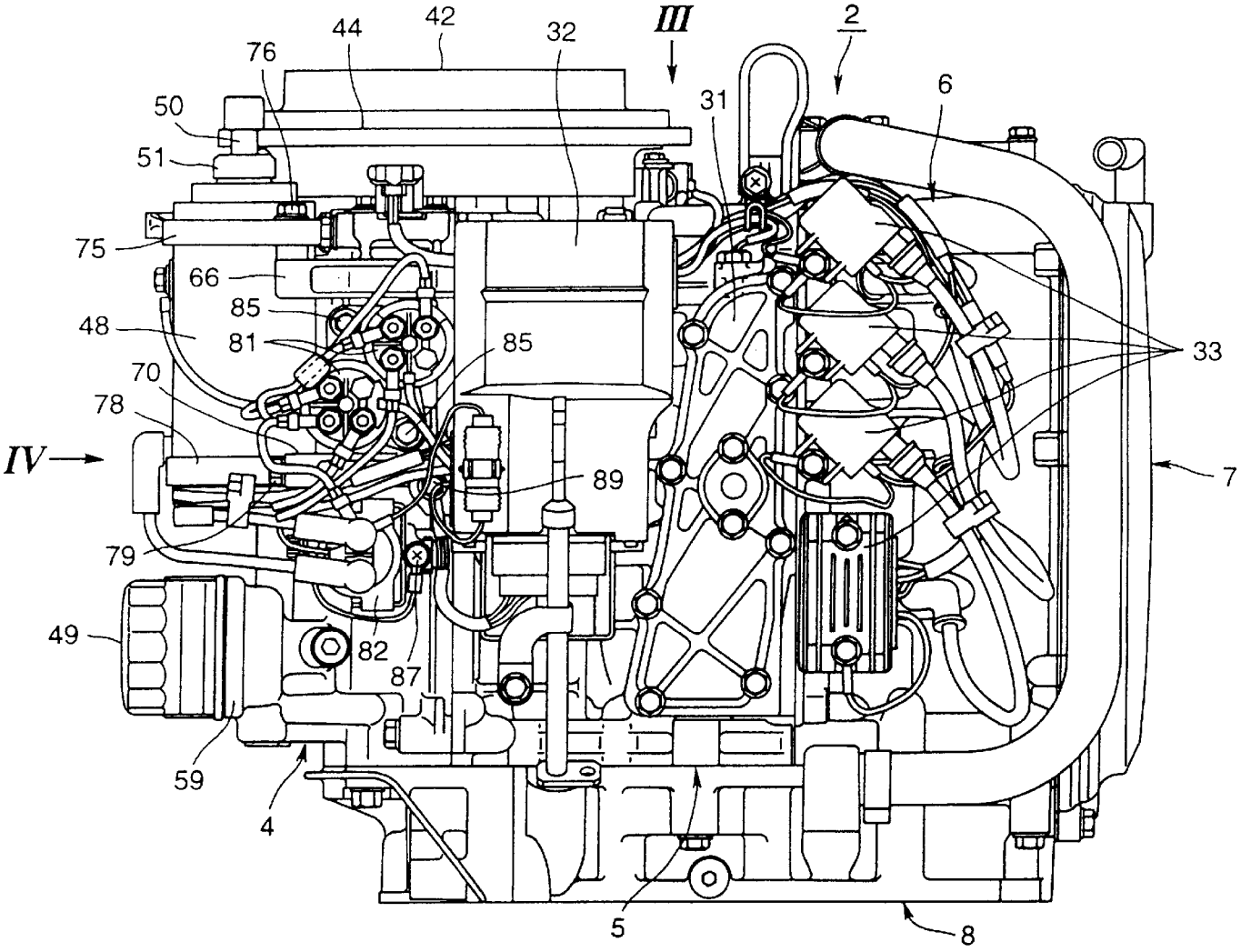
FIG. 2 is a left side view of an engine and an engine holder.
Figure 3:
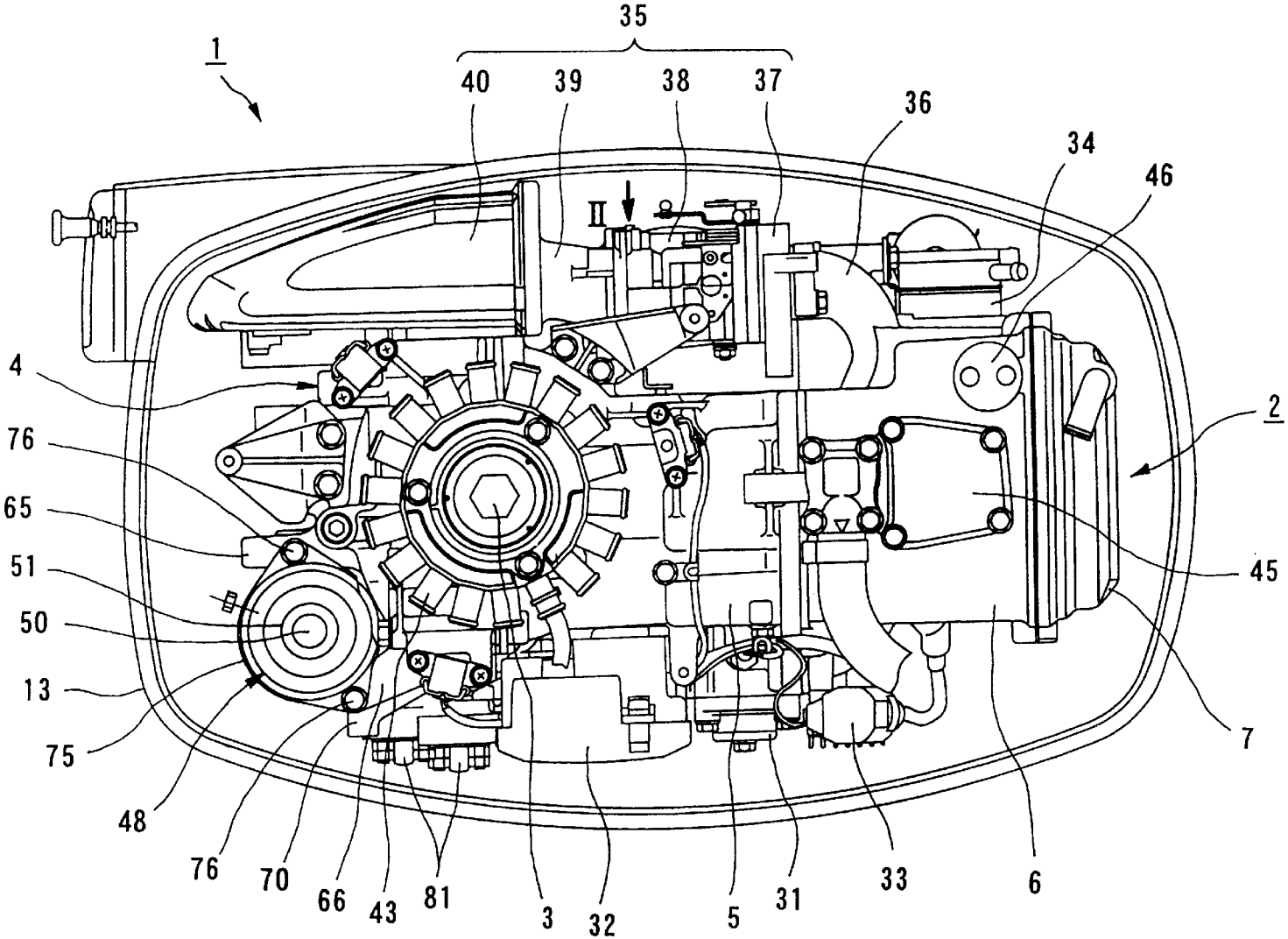
FIG. 3 is a plan view of the engine viewed from the arrow III in FIG. 2.
Figure 4:
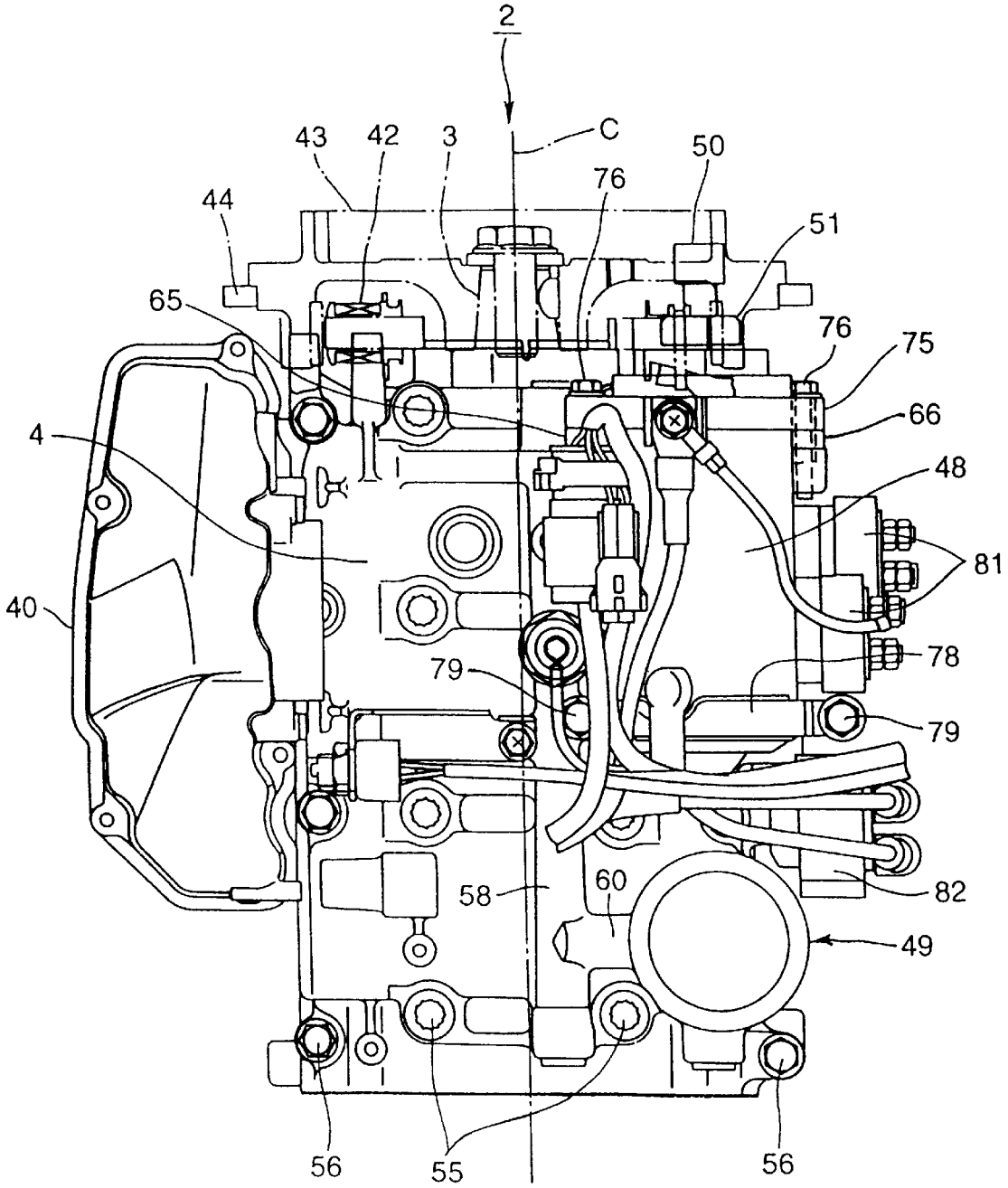
FIG. 4 is a front view of the engine viewed from an arrow IV in FIG. 2 and shows an embodiment of the invention.

FIGS. 2, 3 and 4 are a left side view of the engine 2 and the engine holder 8, a plan view of the engine 2, and a front view of the engine 2, respectively. As shown in these figures, units such as an exhaust system 31, an electric equipment box 32 and an ignition unit 33 are disposed on the left surface of the engine 2, for example, and a fuel pump 34 and an intake system 35 are disposed on the right surface of the engine 2, for example. The intake system 35 comprises a multi-carburetor bracket 37 connected to an intake manifold 36 extending from the cylinder head 6, three carburetors 38 mounted in the multi-carburetor bracket 37 and arranged vertically and an intake silencer 40 connected to a rear end of each carburetor 38 through an intake pipe 39.

A flywheel 42 is disposed on an upper surface of the engine 2, and an electric generating unit 43 is provided therein. The flywheel 42 is integrally formed on an upper end of the crankshaft 3 projecting from the upper surface of the engine 2 such that the flywheel 42 rotates in unison with the crankshaft 3, and a ring gear 44 is provided therearound. The cylinder head 6 is provided at its upper surface with a thermostat housing 45 and an oil injecting port 46.

Further, on a front surface of the engine 2, a starter motor 48 is disposed in an upper portion of a front surface of the crankcase 4 (hull side) and an oil filter 49 is disposed below the starter motor 48. The starter motor 48 and the oil filter 49 are disposed so as to be deviated sideways, e.g., left side with respect to an axis C of the crankshaft 3 as shown in FIG. 4. A pinion gear 51 is provided on a main shaft 50 of the starter motor 48 in a manner that if the starter motor 48 is actuated, the pinion gear 51 slides upward and meshes with the ring gear 44 of the flywheel 42 to allow the latter to rotate, thereby starting the engine 2.

With reference to FIGS. 5 to 8, eight fastening bosses 53 and eight fastening bosses 54 are formed on the front surface of the crankcase 4. As shown in FIG. 4, these fastening bosses 53 and 54 are fastened to the cylinder block 5 by means of two kinds of fixing bolts 55 and 56. A pipe-like main oil gallery 58 is formed on a central portion of the front surface of the crankcase 4 substantially along the axis C of the crankshaft 3, a cup-like filter mount 59 opened forward is provided closer to the left side of a lower portion of the front surface of the crankcase 4. A filter oil passage 60 connecting between the main oil gallery 58 and the filter mount 59 are formed horizontally. The filter mount 59 is provided with the oil filter 49 which projects forward (i.e. towards the hull).

Figure 8:
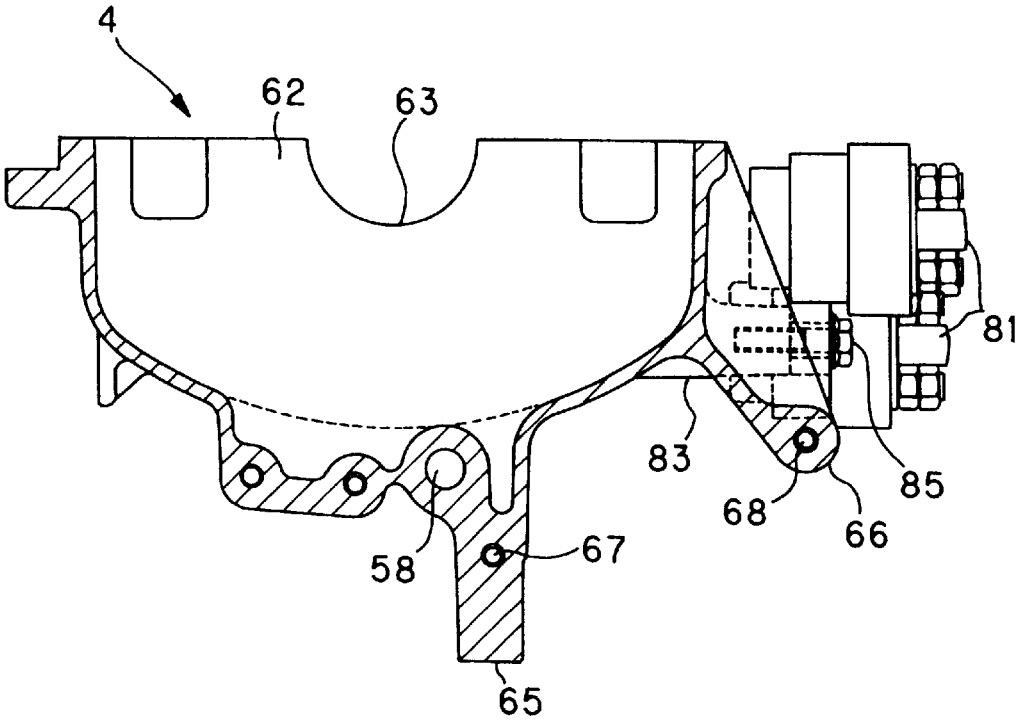
FIG. 8 is a transverse sectional view of the crankcase taken along the line VIII—VIII in FIG. 5.
Figure 9:
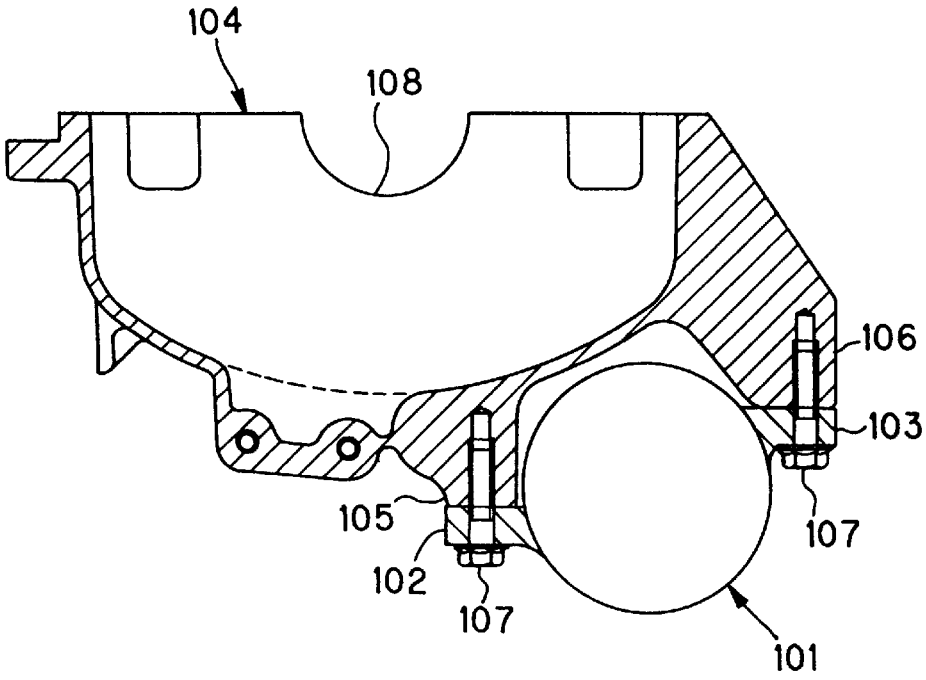
PRIOR ART FIG. 9
FIG. 9 is a transverse sectional view of a crankcase and a starter motor showing a conventional structure.
Figure 10:
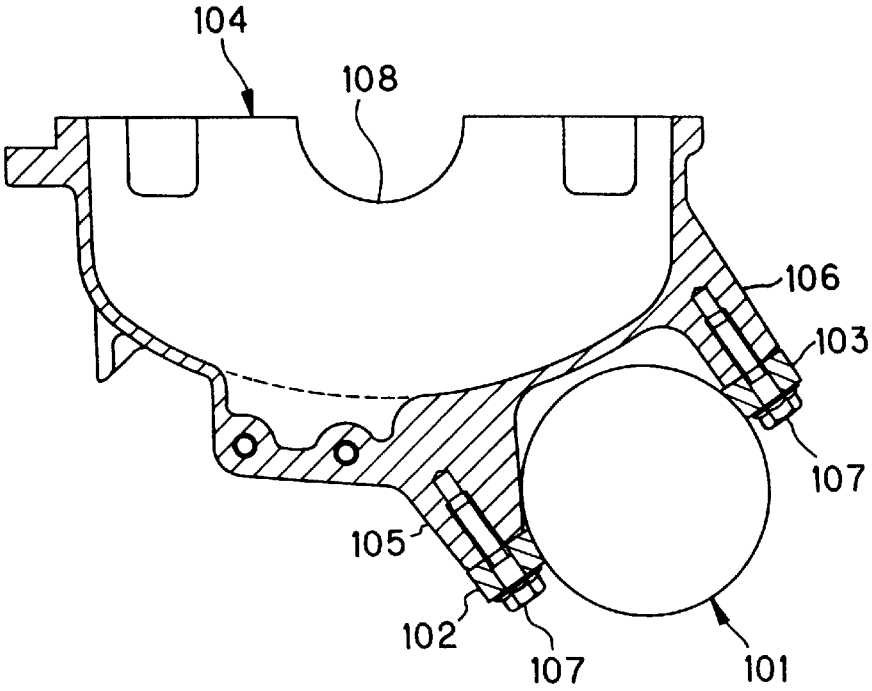
PRIOR ART FIG. 10
FIG. 10 is a transverse cross sectional view of a crankcase and a starter motor showing another conventional structure.

An interior of the crankcase 4 is divided by two partition walls (see FIG. 8). A semi-cylindrical crank bearing 63 (see FIG. 7) formed to these partition walls 62 and upper and lower surfaces of the crankcase 4 is aligned with another crankshaft bearing, not shown, formed on the side of the cylinder block 5, and the crankshaft 3 is rotatably pivotally supported therebetween.

Furthermore, the upper portion of the front surface of the crankcase 4 is provided with a pair of starter fixing bosses 65, 66 projecting horizontally forward. The pair of the starter fixing bosses 65, 66 are formed with screw holes 67, 68 directed in the vertical direction (see FIGS. 7 and 8). A starter holding boss 70 is formed below the starter fixing bosses 65, 66, i.e., in the vicinity of the central portion of the front surface of the crankcase 4. The starter holding boss 70 is provided with a semi-cylindrical holding inner peripheral surface 71 and flat fastening seat surfaces 72 and 73 positioned at opposite sides of the holding inner surface 71.

On the other hand, a horizontally spreading fixing flange 75 is provided in the vicinity of the upper end of the starter motor 48. The fixing flange 75 is mounted on the starter fixing bosses 65, 66 of the crankcase 4. Two fixing bolts 76 directed in the vertical direction pass through bolt holes, not shown, formed to the fixing flange 75 and fastened to the screw holes 67, 68 of the starter fixing bosses 65, 66. With this structure, the upper portion of the starter motor 48 is fixed to the crankcase 4.

A lower portion of the starter motor 48 is tightly fitted to the holding inner peripheral surface of the starter holding boss 70 and is fixed by a holding band 78 (see FIGS. 2 and 4) from the forward side. An intermediate inner peripheral surface of the holding band 78 is abutted against an outer peripheral surface of the starter motor 48, and the opposite ends of the holding band 78 are fastened to the fastening seat surfaces 72, 73 of the starter holding boss 70 by the fixing bolt 79. With this structure, the lower portion of the starter motor 48 is held between the starter holding boss 70 (holding inner peripheral surface 71) and the holding band 78.

Other electrical equipments or parts such as PTT relays 81 are disposed in a space between the starter fixing boss 66 and the starter holding boss 70. The PTT relay 81 is a relay for a PTT apparatus (power tilt trim apparatus) which is not shown. A starter relay 82 is disposed directly below the starter holding boss 70, for example.

Figure 5:
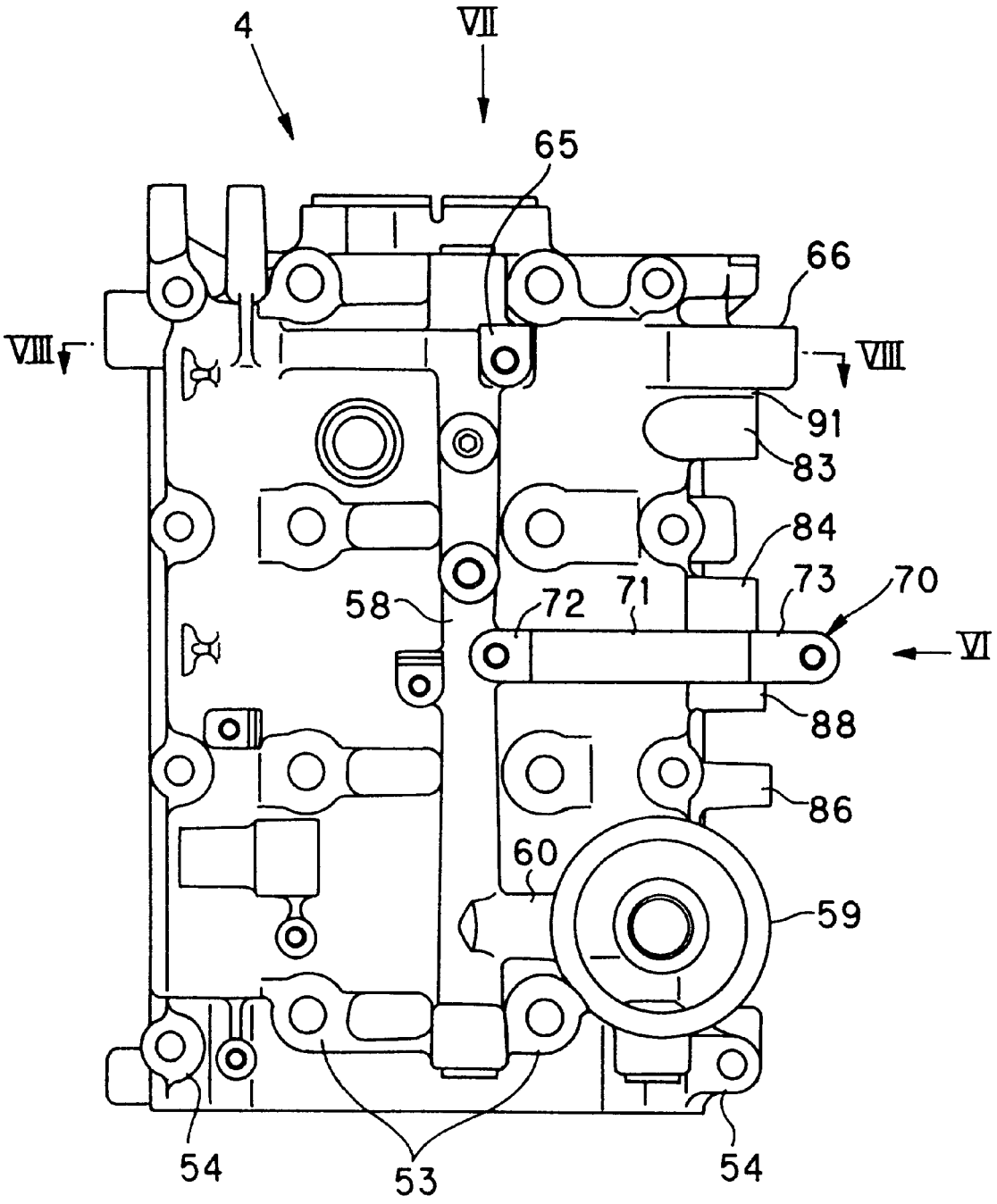
FIG. 5 is a front view of a crankcase.
Figure 6:
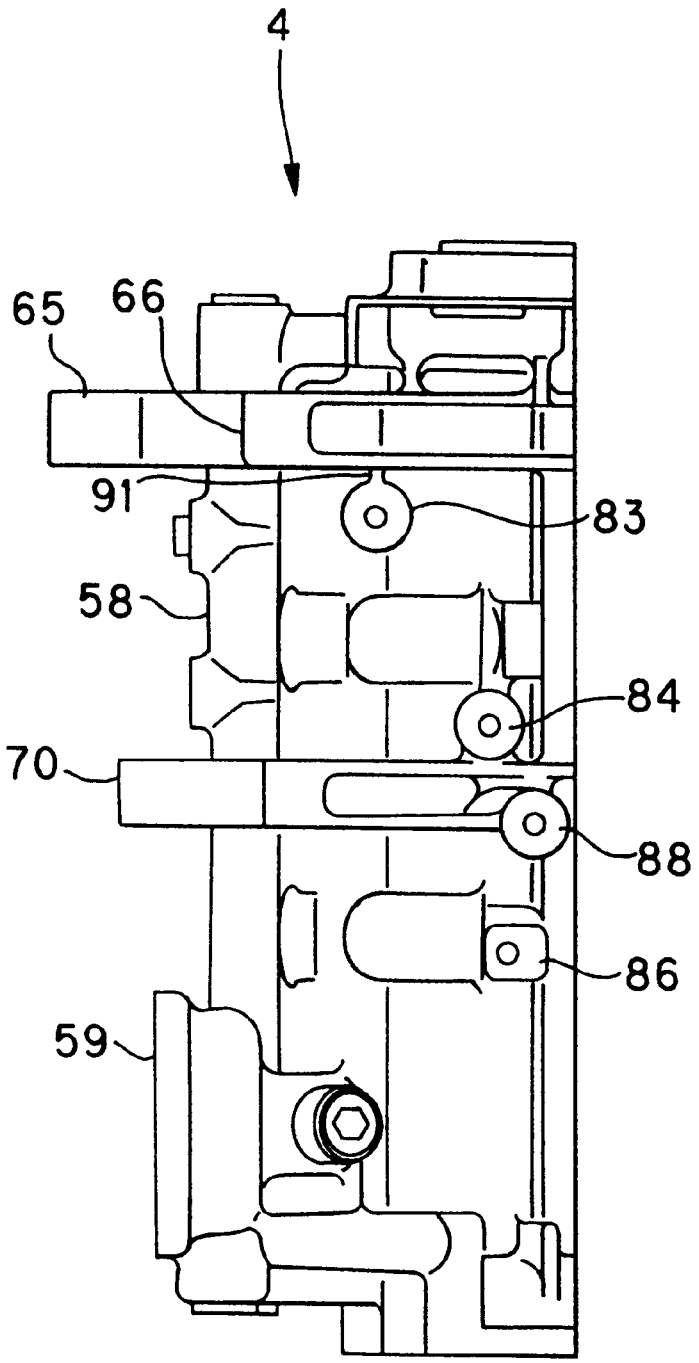
FIG. 6 is a left side view of the crankcase viewed from the arrow VI in FIG. 5.
Figure 7:
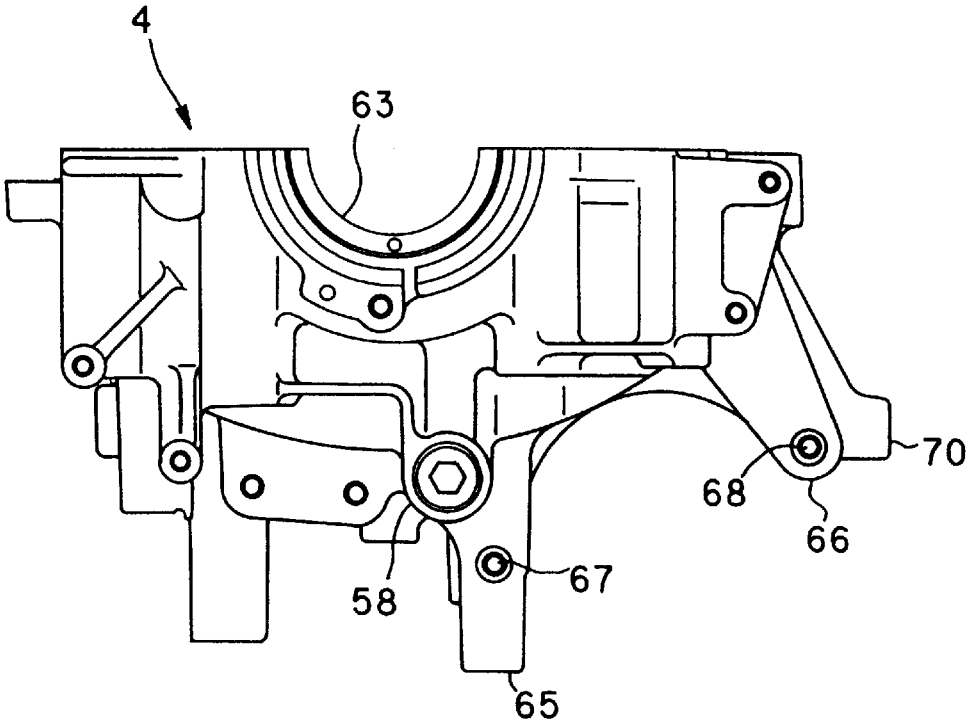
FIG. 7 is a plan view of the crankcase viewed from the arrow VII in FIG. 5.

As shown in FIGS. 5 and 6, the PTT relays 81 are fastened and fixed to a part fixing boss 83 formed adjacent the portion directly below the starter fixing boss 66 and a part fixing boss 84 formed adjacent the portion directly above the starter holding boss 70 by means of fixing bolts 85 (see FIGS. 2 and 8). On the other hand, the starter relay 82 is fastened and fixed to a part fixing boss 86 provided below the starter holding boss 70 by means of fixing boss 87. An electric equipment box 32 is fastened and fixed to a part fixing boss 88 formed in the vicinity of the directly below portion of the starter holding boss 70 by means of fixing bolt 89 (see FIG. 2).

The part fixing boss 83 is integrally formed with the starter fixing boss 66 through a short rib 91. The part fixing boss 84 and the part fixing boss 88 are integrally formed with the starter holding boss 70.

In the outboard motor 1 having the structure mentioned above of the present invention, since the starter motor 48 and the oil filter 49 are respectively arranged at the upper and lower positions on the front surface of the crankcase 4, it is possible to dispose the starter motor 48 and the oil filter 49 while utilizing the space efficiently. Further, since the oil filter 49 is disposed forward of the engine 2, the oil filter 49 can be extremely easily exchanged from the hull side, and the maintenance performance of the engine 2 is excellent. In an outboard motor in which the starter motor 48 is not included and the engine is started only by a recoil starter, since the starter motor 48 is not provided above the oil filter 49, the attaching and detaching operation of the oil filter 49 can be further facilitated.

Further, since the starter motor 48 and the oil filter 49 are disposed so as to be deviated sideways in location with respect to the axis C of the crankshaft 3 as viewed from the front side in a state where the starter motor 48 and the oil filter 49 are respectively arranged at the upper and lower positions on the front surface of the crankcase 4 in this manner, the projecting amounts of the starter motor 48 and the oil filter 49 from the front surface of the crankcase 4 are small, and the forward and backward length of the engine 2 is shortened. Therefore, the outboard motor 1 can be made compact.

Furthermore, when the starter motor 48 is mounted, the starter fixing bosses 65, 66 are horizontally projected from the upper portion of the crankcase 4, the horizontally spreading fixing flange 75 is provided on the upper end of the starter motor 48, the fixing flange 75 is mounted on the starter fixing bosses 65, 66, and the fixing flange 75 is fastened and fixed to the starter fixing bosses 65, 66 by means of the fixing bolts 76 directed in the vertical direction. Therefore, the axial direction of the crank bearing 63 of the crankcase 4 and the axial directions of the screw holes 67, 68 of the fixing bolts 76 coincide with each other, and thus, the crank bearing 63 and the screw holes 67, 68 can be formed at the same time.

Therefore, when the starter motor 48 is assembled into the engine 2, the relative positional precision of the starter motor 48 with respect to the crankshaft 3 can be enhanced, and the engagement backlash between the pinion gear 51 of the starter motor 48 and the ring gear 44 around the flywheel 42 can be set to a proper amount. Furthermore, since the positions where the starter fixing bosses 65, 66 are formed are less prone to be influenced by the shape and the like of the crankcase 4, the flexibility of the position of starter motor 48 can be remarkably enhanced.

Still furthermore, when the starter motor 48 is assembled, if the fixing flange 75 of the starter motor 48 is placed on the starter fixing bosses 65, 66, the entire weight of the starter motor 48 is supported by the starter fixing bosses 65, 66. Therefore, it is unnecessary to keep holding the starter motor 48 with a hand, and the fixing bolt 76 can be fastened by using both hands. Therefore, the mounting operability of the starter motor 48 can be extremely improved.

Further, since the lower portion of the starter motor 48 is held by the starter holding boss 70 provided below the starter fixing bosses 65, 66 and the holding band 78 fastened to the starter holding boss 70 by the fixing bolt 79, it is possible to strongly hold the starter motor 48 with the extremely simple structure. Furthermore, since the holding positions by the starter holding boss 70 and the holding band 78 can be selected along the axial direction of the starter motor 48, the flexibility of height, at which the starter holding boss 70 is disposed, is enhanced, and the design becomes easy.

On the other hand, although there exists a dead space between the starter holding boss 70 and the starter fixing bosses 65, 66, since the PTT relay 81 is disposed in this space, the dead space can be effectively utilized, as well as enhancing the outer appearance. Another part may be disposed in this space other than the PTT relay 81.

Furthermore, the part fixing bosses 83, 84 and 88 for fixing the PTT relay 81 and the electric equipment box 32 to the crankcase 4 are integrally formed with the starter fixing boss 66 and the starter holding boss 70. Therefore, the strong starter fixing boss 66 and the starter holding boss 70 also function as the part fixing bosses 83, 84 and 88 which required the strength in the conventional structure, and thus, it is possible to enhance the strength of the part fixing bosses 83, 84 and 88 and to increase the resistance to vibration. Still furthermore, since it is unnecessary to increase the thickness of the part fixing bosses 83, 84 and 88 for enhancing the strength, this contributes to the reduction in weight.

It is to be noted that the present invention is not limited to the described embodiment and many other changes and modifications may be made without departing from the scopes of the appended claims.

What is claimed is:

1. An outboard motor comprising:

an engine of a vertical type including:

a crankcase in which a crankshaft extends vertically perpendicularly, a cylinder block disposed at a rear side of said crankcase, and a cylinder head disposed at a rear side of said cylinder block when said outboard motor is mounted on a hull of a motorboat in an operational position for propelling the motorboat;

a starter motor mounted to a front surface portion of said crankcase; and an oil filter mounted to said crankcase at a portion below said starter motor, wherein said starter motor and said oil filter are both located so as to be a predetermined distance offset to a left of an approximately vertical plane through a center of said outboard motor and containing a central longitudinal axis of said crankshaft which is substantially vertical when said outboard motor is mounted on the hull of the motorboat in an operational position for propelling the motorboat.

2. The outboard motor according to claim 1, wherein said crankcase is provided at an upper portion thereof with a starter fixing boss projecting horizontally and said starter motor is fastened to said starter fixing boss via a fixing bolt which is directed in a perpendicular direction.

3. The outboard motor according to claim 2, wherein said starter motor is provided with a fixing flange which spreads in a horizontal direction and said fixing flange is mounted on said starter fixing boss via said fixing bolt.

4. The outboard motor according to claim 2, wherein said crankcase is provided with a starter holding boss located below said starter fixing boss, and further comprising a holding band fixed to said starter holding boss such that a lower portion of said starter motor is held between said holding band and said starter holding boss.

5. The outboard motor according to claim 4, further comprising an electrical element disposed between said starter fixing boss and said starter holding boss.

6. The outboard motor according to claim 5, wherein at least one of said starter fixing boss and said starter holding boss is integrally formed with a fixing boss for fixing said electrical element.

7. The outboard motor according to claim 1, wherein said starter motor and said oil filter are arranged with vertical alignment.

* * * * *